US005222261A

United States Patent [19]

Tooze et al.

[11] Patent Number: 5,222,261

[45] Date of Patent: Jun. 29, 1993

[54] SHOWER SCREEN

[75] Inventors: Peter J. Tooze; Stephen K. Marshall, both of Leeds, United Kingdom

[73] Assignee: Heatons Bathrooms Limited, Rotherham, England

[21] Appl. No.: 741,455

[22] PCT Filed: Feb. 22, 1990

[86] PCT No.: PCT/GB90/00275

§ 371 Date: Oct. 3, 1991

§ 102(e) Date: Oct. 3, 1991

[87] PCT Pub. No.: WO90/09754

PCT Pub. Date: Sep. 7, 1990

[30] Foreign Application Priority Data

Feb. 23, 1989 [GB] United Kingdom ..... 8904144.6

[51] Int. Cl.[5] ..... A47K 3/14; E04B 2/74

[52] U.S. Cl. ..... 4/608; 4/609

[58] Field of Search ..... 4/558, 585, 608, 609; 160/134

[56] References Cited

U.S. PATENT DOCUMENTS 1,443,753 1/1923 McClure .
3,386,106 6/1968 Clemens ..... 4/608
4,675,923 6/1987 Ashley ..... 4/599

FOREIGN PATENT DOCUMENTS 1563194 3/1969 France .
1563195 3/1969 France .
2180266 10/1973 France .
2544976 11/1984 France ..... 4/609

*Primary Examiner*—Charles E. Phillips
*Attorney, Agent, or Firm*—Trexler, Bushnell, Giangiorgi & Blackstone, Ltd.

[57] ABSTRACT

A folding shower screen comprises an attachment channel member (3, 18) adapted to be secured to a wall (2), e.g., at one end of a bath (1) in general co-planar alignment with the outer side (7) of the bath, a hinge (4) disposed at a lower end of the attachment member, a movable channel member (5, 13) secured to the hinge and pivotable between a stowed position alongside the attachment member and a deployed position (as shown) resting along the bath lip (8), and a generally quadrant shaped collapsible screen element (6) extending between the attachment member (3, 18) and the movable member (5, 13), water collected in a sump (11) being directed towards the bath (1) by a conduit (12) and water collected in the movable channel member (13) being directed into the bath by slots (14) in the one side of the channel member.

14 Claims, 4 Drawing Sheets

SHOWER SCREEN

This invention relates to a folding shower screen, particularly but not exclusively for attachment to a bath.

Conventional shower screens for baths comprise curtains or rigid panels. Shower curtains are inconvenient when in the stowed position either occupying bath space or dripping over the side of the bath. Sliding panels, to be secure, require installation of permanent track upon the side of the bath and/or along the ceiling, which can be uncomfortable or dangerous to the user. A hinged panel is a permanent incumberance to the bather.

However, it is also known from U.S. Pat. No. 3,386,106 for a folding shower screen to comprise an attachment member adapted to be secured to a wall, a hinge disposed at a lower end of the attachment member, a movable member secured to the hinge and pivotable between a stowed position alongside the attachment member and a deployed position, and a generally quadrant shaped collapsible screen element with folds radiating from the hinge and secured between the attachment member and the movable member.

With the attachment member secured to a bathroom wall in general co-planar alignment with the outer side of the bath and with the hinge adjacent the top of the bath, the movable member rests in its deployed position along the bath lip at the outer side and the collapsible screen element is disposed in extended condition between the attachment member and the movable member.

The present invention provides for greater lateral rigidity yet easier collapsibility as compared with the screen of U.S. Pat. No. 3,386,106.

According to the present invention, a folding shower screen having an attachment member, a hinge, a movable member, and a screen element as in U.S. Pat. No. 3,386,106 is characterised in that the collapsible screen element is formed by a generally rectangular plastics sheet incorporating parallel alternating folds, the two end folds being attached respectively to the attachment member and the movable member, whereby, when the collapsible screen element is in extended condition it exhibits the generally quadrant shape, and in that the radial width of the screen element is progressively reduced from the attachment member to the movable member.

The width of the folds of the screen element and rigidity of the material from which it is composed may be selected to enhance the lateral rigidity of the screen element, avoiding any need for reinforcing members. Alternatively, or in addition, reinforcing members may be provided, for example, in the manner of a sail with battens or other supporting struts. However easy collapsibility is ensured by the progressive reduction of the radial width of the screen element from the attachment member to the movable member.

Use of alternating or zig-zag parallel folds not only provides a collapsible screen element having lateral rigidity and which folds easily into a small volume, but also affords the advantage that water may be squeezed from the screen element and collected at the hinge as the screen is folded into the vertical stowed position. The hinge is preferably incorporated in an assembly above a sump with a conduit for collecting water draining from the screen element and directing it towards the bath. The sump is preferably removable for easy cleaning.

A drainage channel is preferably provided along the movable member for water draining directly from the screen element towards the bath, one side of the drainage channel being provided with apertures (e.g., holes or slots) for water to drain into the bath. Thus the movable member is preferably formed by a channel member with apertures (e.g., holes or slots) provided in one side for collecting water draining directly from the screen element towards the bath and directing it into the bath. The disposition of the hinge above the sump has the advantageous effect that in the deployed position the drainage channel has a slight downward inclination away from the hinge, thus assisting in distributing collected water towards apertures farther away from the hinge. The hinge end of the drainage channel is preferably adapted to communicate with the sump when the movable member is in stowed position alongside the attachment member, and the end of the drainage channel remote from the hinge preferably has a removable closure to faciiitate cleaning of the drainage channel. The lower surface of the movable member preferably has a lip or a groove or grooves to prevent water from seeping between the movable member and the lip of a bath.

Conveniently, the attachment member is also formed by a channel member (which may be identical to the channel member forming the movable member, including a removable closure at the end remote from the hinge) without drainage apertures but possibly with key-hole slots in its base or back for detachably securing by screws to a bathroom wall, the two channel members forming, when the movable member is in stowed position alongside the attachment member, a box enclosing the collapsible screen element.

A catch on one (or each) side of the attachment member may be pivoted so as to effect automatic engagement with a projection on the corresponding side of the movable member when the latter is brought into stowed position alongside the former.

The screen element is preferably detachable from both channel members for thorough cleaning. Thus the inside of the base or back of each channel member may be provided with a re-entrant groove for snap engagement by a bead along the free edge of the respective end fold of the collapsible screen element.

An embodiment of the invention will now be described, by way of example only, with reference to the accompanying drawings, in which.

Figure 4:
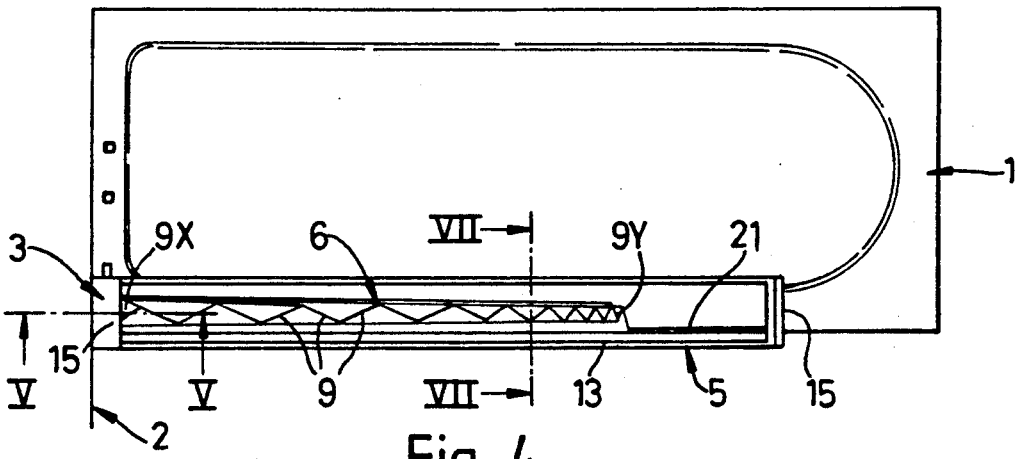
FIG. 4 is a plan view of the screen corresponding to FIGS. 1 and 2.
Figure 5:
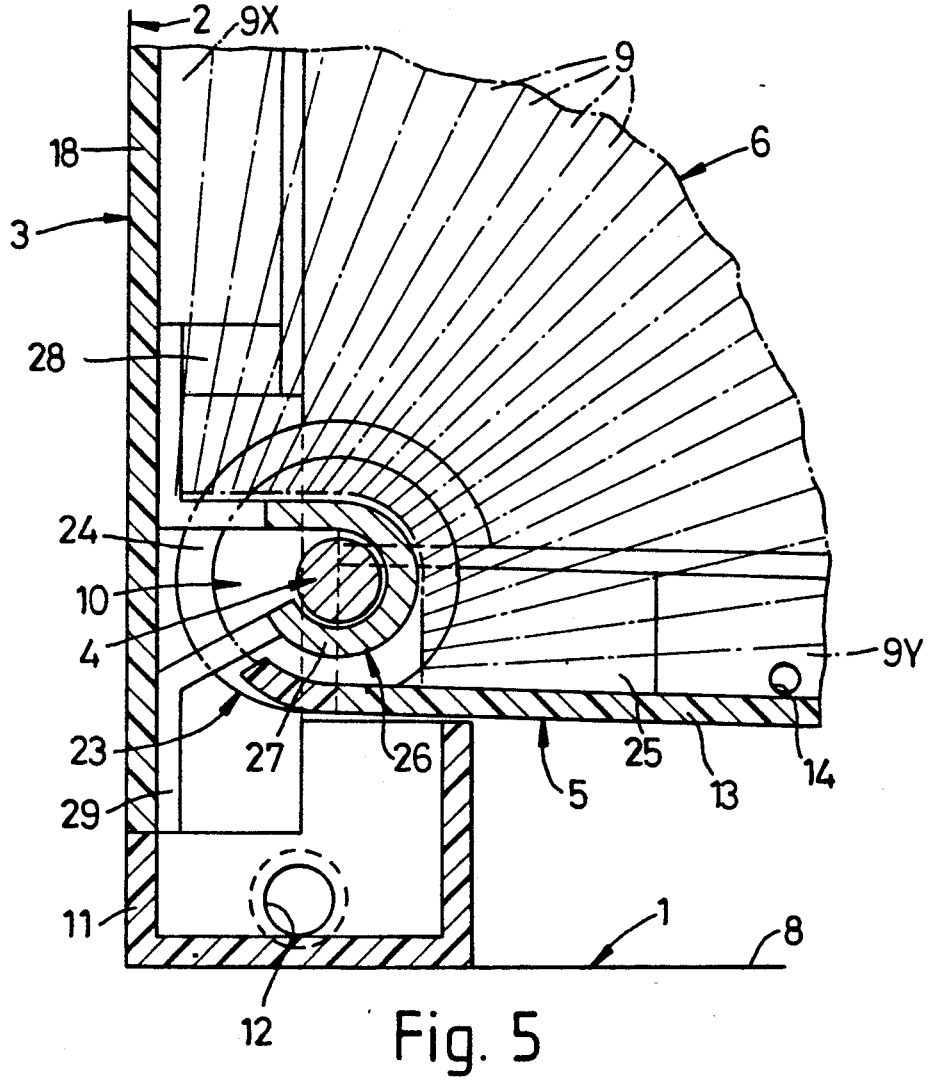
FIG. 5 is an enlarged fragmentary vertical section taken from the line V—V in FIG. 4.
Figure 7:
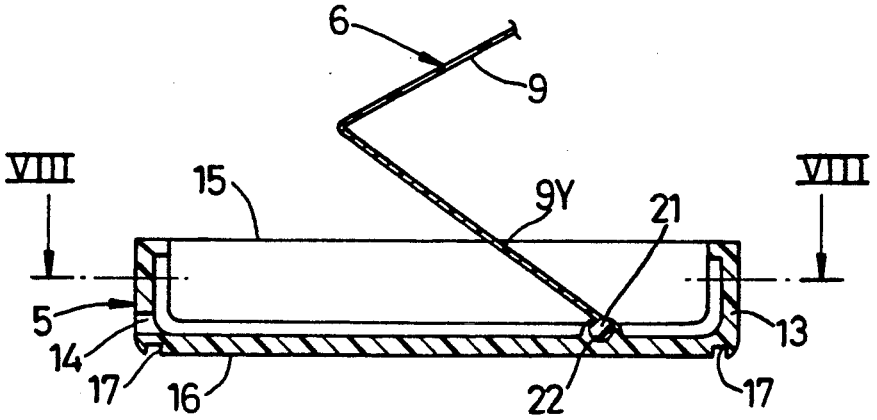
Figure 6:
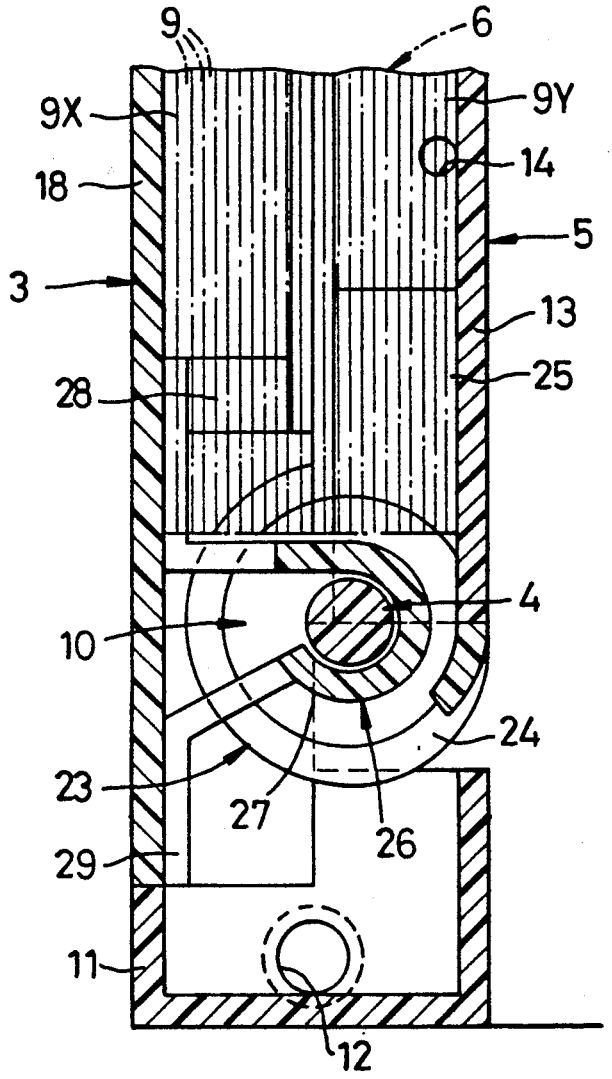
Figure 8:
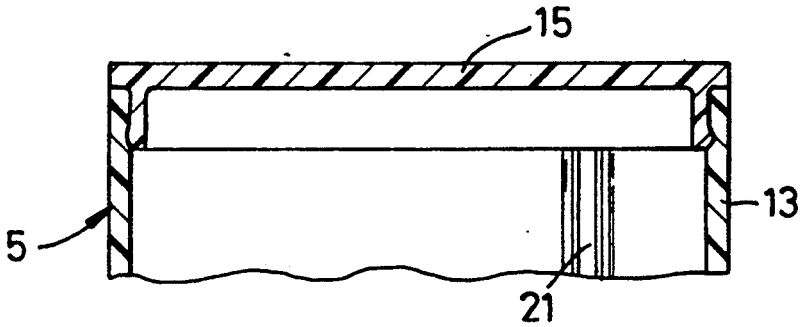

FIG. 6 corresponds to FIG. 5 but shows the screen in the stowed position;

FIG. 7 is an enlarged fragmentary vertical section taken from the line VII—VII in FIG. 4; and FIG. 8 is a fragmentary horizontal section taken from the line VIII—VIII in FIG. 7.

The folding shower screen is shown in the drawings used in association with a bath 1 having one end against a wall 2, and the screen comprises an attachment member 3 adapted to be secured to the wall 2, a hinge 4 at a lower end of the attachment member 3, a movable member 5 secured to the hinge 4 and pivotable between a stowed position alongside the attachment member 3 (see FIGS. 3 and 6) and a deployed position (see FIGS. 1, 2, 4 and 5) and a collapsible screen element 6 extending between the attachment member 3 and the movable member 5.

It will be apparent from FIGS. 1 to 4 that with the attachment member 3 secured to the bathroom wall 2 in general co-planar alignment with the outer side 7 of the bath 1 and with the hinge 4 adjacent the top of the bath, the movable member 5 rests in its deployed position (FIGS. 1, 2 and 4) along the bath lip 8 at the outer side and the collapsible screen element 6 is disposed in extended condition between the attachment member 3 and the movable member 5.

The collapsible screen element 6 comprises a generally rectangular sheet of polypropylene, or other waterproof flexible material, incorporating a multiplicity of parallel alternating folds 9, with the two end folds 9X, 9Y attached respectively to the attachment member 3 and the movable member 5. The profile of the screen element when deployed is generally quarter-circular, with the folds radiating from the hinge area, but for easy collapsibility there is a progressive reduction of the radial width from the attachment member 3 to the movable member 5. For example, the deployed screen element may have a vertical height of 140 cm and a horizontal length of 110 cm, even though it is convenient for the attachment member 3 and the movable member 5 to be of substantially equal length, say 150 cm. Polypropylene having a thickness of 400 to 500 microns has been found suitable to provide lateral rigidity without needing any reinforcing members but affording easy stowing with, say, 24 folds.

Figure 3:
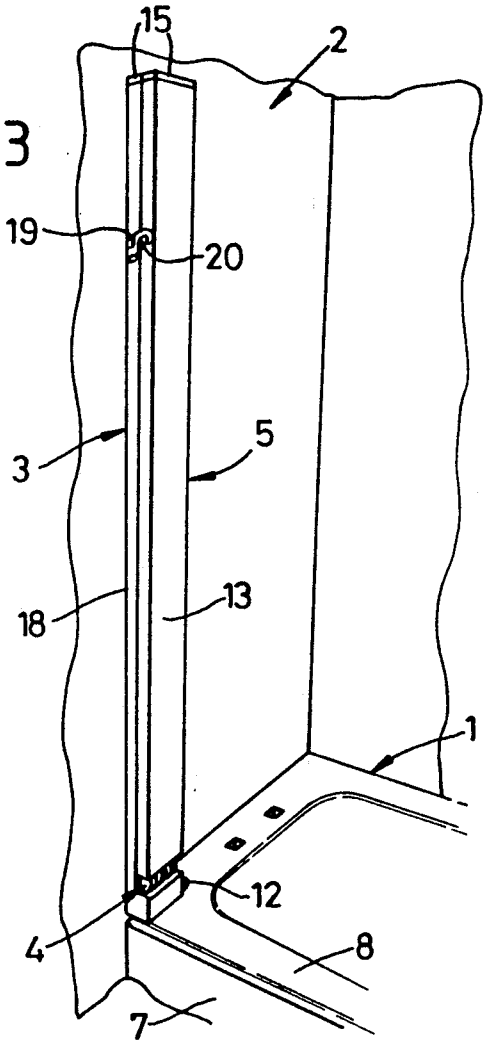
FIG. 3 is a perspective view from the same side as FIG. 1, showing the screen in the stowed position.
Figure 1:
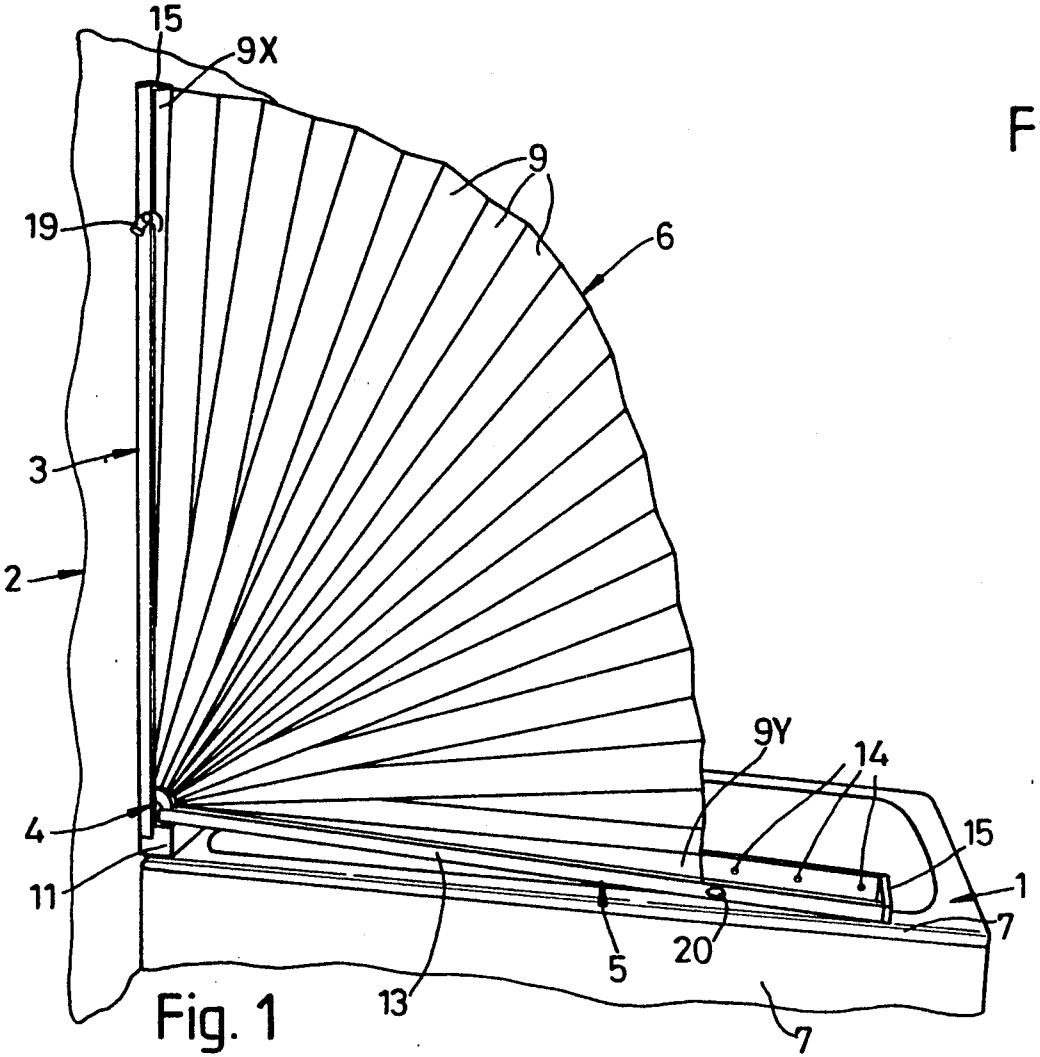
FIG. 1 is a perspective view illustrating use of a folding shower screen in accordance with the invention.
Figure 2:
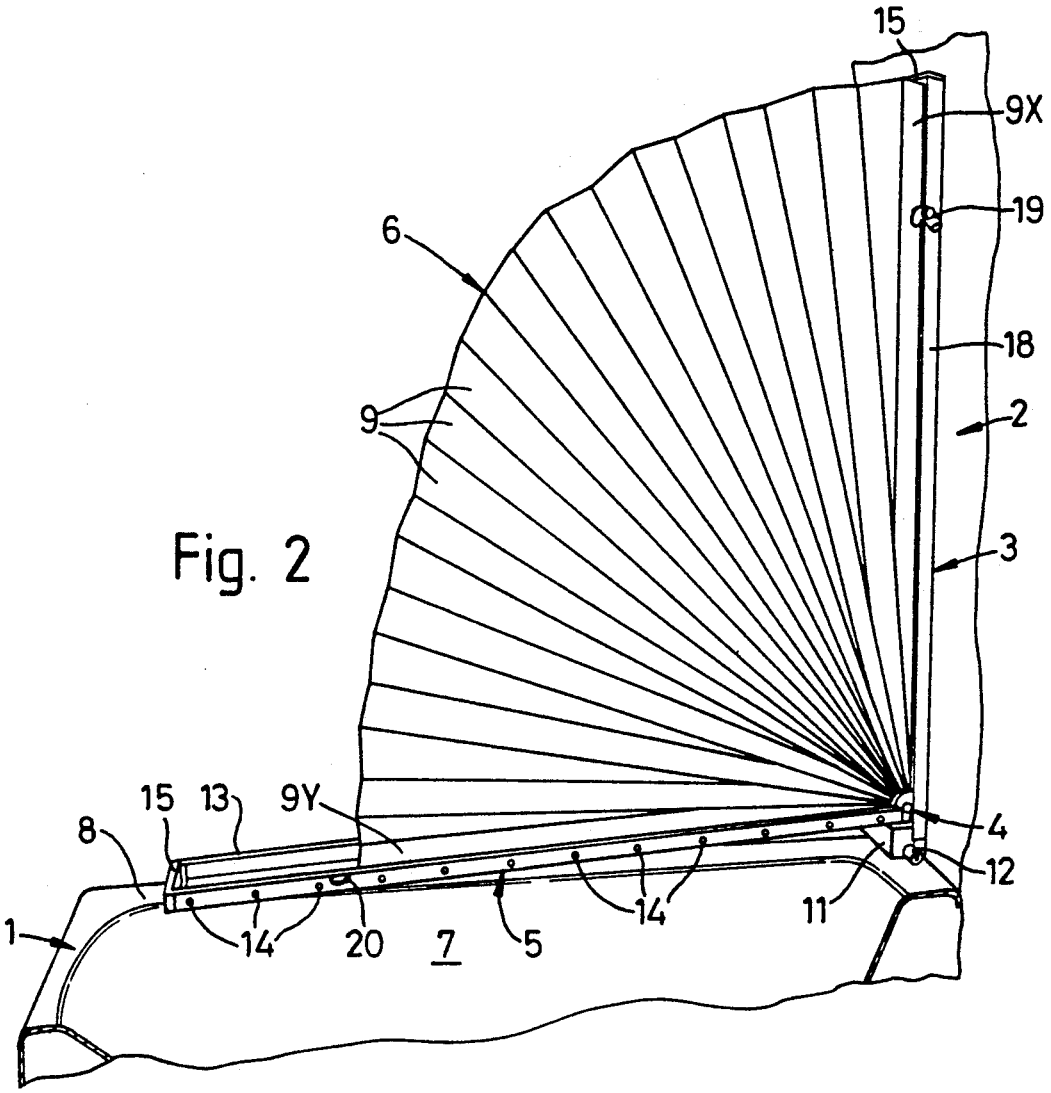
FIG. 2 is a perspective view of the other side of the screen.

In addition to folding easily into a small volume, the collapsible screen element 6 also affords the advantage that water may be squeezed from the screen element and collected at the hinge 4 as the screen is folded into the vertical stowed position (FIGS. 3 and 6). Accordingly, the hinge 4 is incorporated in an assembly 10 above a sump 11 with a conduit 12 for collecting water draining thus from the screen element 6 and directing it towards the bath 1, the sump 11 (with the conduit 12) being removable, as indicated by the arrow in FIG. 6, for easy cleaning.

The movable member 5 is formed by a channel 13 with apertures 14 provided in one side for collecting water draining directly from the screen element 6 towards the bath 1 and directing it into the bath. The disposition of the hinge 4 above the sump 11 has the advantageous effect that in the deployed position (FIGS. 1, 2, 4 and 5) the drainage channel 13 has a slight downward inclination away from the hinge, thus assisting in distributing collected water towards apertures 14 farther away from the hinge. The hinge end of the channel 13 is adapted to communicate with the sump 11 when the movable member 5 is in stowed position (see FIG. 6), and the end of the channel remote from the hinge has a removable closure 15 (see FIGS. 7 and 8) to facilitate cleaning of the channel. The lower surface 16 of the movable member has grooves 17 to prevent water from seeping between the movable member and the bath lip 8.

The attachment member 3 is also formed by a channel 18 (which is identical to the channel 13, including a removable closure 15 at the end remote from the hinge 4), without drainage apertures, but possibly with keyhole slots (not shown) in its base or back for detachably securing by screws to the bathroom wall 2, the two channels 13, 18 forming, when the movable member 5 is in stowed position alongside the attachment member 3 (see FIGS. 3 and 6), a box enclosing the collapsed screen element 6. A catch 19 on each side of the attachment member 3 is pivoted so as to effect automatic engagement with a projection 20 on the corresponding side of the movable member 5 when the latter is brought into stowed position alongside the former.

The inside of the base or back of each channel 13, 18 is provided with a re-entrant groove 21 for snap engagement by a bead 22 along the free edge of the respective end fold 9Y, 9X of the collapsible screen element 6 to enable the screen element to be detached from both channels for thorough cleaning.

FIGS. 5 and 6 show that the hinge assembly 10 consists of a spindle member 23 having flanges 24 at the ends of the hinge 4 with lugs 25 for cementing to the inner sides of the channel 13 forming the movable member 5, and a supporting member 26 having a bearing portion 27 capable of being sprung over the hinge 4 and having lugs 28 for cementing to the inner sides of the channel 18 forming the attachment member 3 and lugs 29 for securing by screws (not shown) to the back of the channel 18.

FIGS. 5 and 6 also indicate that the channels 13, 18, the sump 11, and the hinge members 23, 26 are all made of plastics, affording a hygenic, durable finish which may be self-coloured to match or suit the colour scheme of the bathroom suite.

What is claimed is:

1. A folding shower screen comprising an attachment member adapted to be secured to a wall, a hinge disposed at a lower end of the attachment member, a movable member secured to the hinge and pivotable between a stowed position alongside the attachment member and a deployed position adapted for lying along one side lip of a bath, and a generally quadrant shaped collapsible screen element with folds radiating from the hinge and secured between the attachment member and the movable member, characterised in that the collapsible screen element is formed by a generally rectangular plastics sheet incorporating parallel alternating folds, the two end folds being attached respectively to the attachment member and the movable member, whereby, when the collapsible screen element is in extended condition it exhibits the generally quadrant shape, and in that the radial width of the screen element is progressively reduced from the attachment member to the movable member.

2. A folding shower screen as in claim 1, wherein the lower surface of the movable member has a lip or a groove to prevent water from seeping between the movable member and the lip of a bath.

3. A folding shower screen as in claim 1, wherein the hinge is incorporated in an assembly above a sump for collecting water draining from the screen element and having a conduit for directing the drained water into the bath.

4. A folding shower screen as in claim 3, wherein the sump is removable for easy cleaning.

5. A folding shower screen as in claim 3 or claim 4, wherein the sump is adapted to space the hinge from a bath lip upon which the sump is placed so that when the movable member is in deployed position only its end remote from the hinge contacts the bath lip.

6. A folding shower screen as in claim 1, wherein the movable member is formed by a channel member for collecting water draining directly from the screen element and provided with at least one aperture in one side for directing the collected water into the bath.

7. A folding shower screen as in claim 6, wherein the hinge end of the drainage channel is adapted to communicate with the sump when the movable member is in stowed position alongside the attachment member.

8. A folding shower screen as in claim 6 or claim 7, wherein the end of the drainage channel remote from the hinge has a removable closure to facilitate cleaning of the drainage channel.

9. A folding shower screen as in claim 6, wherein the attachment member is also formed by a channel member without any drainage aperture or apertures.

10. A folding shower screen as in claim 9, wherein the attachment channel member is provided with key-hole slots in its base or back for detachably securing by screws to a bathroom wall.

11. A folding shower screen as in claim 1, wherein a catch on one or each side of the attachment member is pivoted so as to effect automatic engagement with a projection on the corresponding side of the movable member when the latter is brought into stowed position alongside the former.

12. A folding shower screen as in claim 1, wherein the screen element is detachable for thorough cleaning.

13. A folding shower screen as in claim 12, wherein the inside of each of the attachment and movable members is provided with a re-entrant groove for snap engagement by a bead along the free edge of the respective end fold of the collapsible screen element.

14. A folding shower screen comprising an attachment member adapted to be secured to a wall, a hinge disposed at a lower end of the attachment member, a movable member secured to the hinge and pivotable between a stowed position alongside the attachment member and a deployed position adapted for lying along one side lip of a bath, and a generally quadrant shaped collapsible screen element with folds radiating from the hinge and secured between the attachment member and the movable member, characterised in that the collapsible screen element is formed by a generally rectangular plastics sheet incorporating parallel alternating folds, the two end folds being attached respectively to the attachment member and the movable member, whereby, when the collapsible screen element is in extended condition it exhibits the generally quadrant shape, and in that the radial width of the screen element is progressively reduced from the attachment member to the movable member; wherein the hinges incorporated in an assembly above a sump for collecting water draining from the screen element, said sump having a conduit for directing the drained water into the bath; said movable member being formed by a channel member for collecting water draining directly from the screen element and provided with at least one aperture in one side of the channel member for directing the collected water into the bath; said attachment member being unapertured so that water does not drain therethrough; said sump being adapted to space the hinge from a bath lip upon which the sump is placed so that when the movable member is in deployed position only its end remote from the hinge contacts the bath lip.

* * * * *